US007299961B2

(12) United States Patent
Stavig, Jr. et al.

(10) Patent No.: US 7,299,961 B2
(45) Date of Patent: Nov. 27, 2007

(54) DEVICE FOR CONTROLLED DEPTH RIVETING

(75) Inventors: Paul N. Stavig, Jr., Puyallup, WA (US); Sujith N. Mally, Bellevue, WA (US); Jeffrey W. Hamilton, Renton, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/366,190

(22) Filed: Mar. 2, 2006

(65) Prior Publication Data

US 2007/0205245 A1 Sep. 6, 2007

(51) Int. Cl.
*B25C 1/08* (2006.01)

(52) U.S. Cl. ..... 227/142; 227/107; 227/110; 227/147

(58) Field of Classification Search ..... 227/107, 227/110, 142, 147
See application file for complete search history.

(56) References Cited

U.S. PATENT DOCUMENTS

| | | | | |
|---|---|---|---|---|
| 2,359,859 A | | 10/1944 | Jarvis | |
| 2,409,377 A | | 10/1946 | Miller | |
| 4,637,539 A | * | 1/1987 | Turcott et al. | 227/156 |
| 4,821,937 A | * | 4/1989 | Rafferty | 227/8 |
| 5,074,453 A | * | 12/1991 | Tachihara et al. | 227/130 |
| 5,096,342 A | | 3/1992 | Blankenship et al. | |
| 5,219,110 A | | 6/1993 | Mukoyama | |
| 5,385,286 A | * | 1/1995 | Johnson, Jr. | 227/8 |
| 6,581,815 B1 | * | 6/2003 | Ho et al. | 227/142 |
| 6,695,192 B1 | * | 2/2004 | Kwok | 227/8 |
| 6,763,992 B2 | * | 7/2004 | Hirai | 227/142 |
| 7,032,797 B2 | * | 4/2006 | Liao | 227/142 |
| 2003/0080172 A1 | | 5/2003 | Hirai | |
| 2004/0035906 A1 | * | 2/2004 | Tucker et al. | 227/142 |

* cited by examiner

*Primary Examiner*—Brian D. Nash
(74) *Attorney, Agent, or Firm*—Jeffrey D. Moy; Weiss & Moy, P.C.

(57) ABSTRACT

An adjustable depth control device for a fastener driving tool has an attachment member which is used to couple the adjustable depth control device to the fastener driving tool. An adjustment member is coupled to the attachment member to adjust and control a driving depth of the fastener driving tool. A stopping head is formed on a rivet die of the fastener driving tool for keeping the rivet die in a chamber of the fastener driving tool and for limiting a distance the rivet die will travel.

16 Claims, 2 Drawing Sheets

DEVICE FOR CONTROLLED DEPTH RIVETING

BACKGROUND OF THE INVENTION

1. Field of the Invention

The present invention relates generally to the field of rivet guns, and more particularly to a device to control the depth of travel of a rivet die of a rivet gun to limit damage to the installation surface area.

2. Background Information

Rivet guns are used for driving rivets, staples, nails, and other fasteners (hereinafter fasteners) into a surface of an object. A problem with present rivet guns is the inability to control the fastener driving depth. This is due to the inconsistency in driving depth depending on how much driving and recoiling force is created.

It is desirable to allow one to control the depth to which the fastener will be driven. Different applications require different driving depths for the fasteners. For some applications it is desirable to drive the fasteners so they are countersunk below the surface of the substrate. For other applications it may be desirable to have the fastener head flush with the surface of the substrate. In other circumstances, it may be required for the fastener head to stand off from the surface of the substrate.

Many fastener driving tools have attempted to control fastener driving depth. Effectively controlling driving depth has been difficult in the past because each fastener is usually driven with the same amount of energy each time that the tool is fired. This has been known to cause fasteners to be driven to an inconsistent depth when there were variations in the density of the surface of the object. This is especially problematic in the aerospace industry where a rivet gun may be the only means to install a fastener. The use of a rivet gun presents several obstacles. First, the rivet gun may damage the structure of an aircraft should the rivet die of the rivet gun extend too far and contact the surface of the aircraft. If the rivet die contacts the surface of the aircraft with too much force, the rivet die will generally damage the structure of the aircraft. Second, the use of a rivet gun may cause damage to the countersunk areas of the aircraft. If the fastener is fully seated, there is a possibility of microcracking the countersunk area of the hole by the rivet gun.

Therefore, it would be desirable to provide a device that overcomes the above problems. The device will allow controlled depth riveting of fasteners in order to prevent damage to a structure being fastened.

SUMMARY OF THE INVENTION

An adjustable depth control device for a fastener driving tool is disclosed. The adjustable depth control device has an attachment member which is used to couple the adjustable depth control device to the fastener driving tool. An adjustment member is coupled to the attachment member to adjust and control a driving depth of the fastener driving tool. A stopping head is formed on a rivet die of the fastener driving tool for keeping the rivet die in a chamber of the fastener driving tool and for limiting a distance the rivet die will travel.

The features, functions, and advantages can be achieved independently in various embodiments of the present inventions or may be combined in yet other embodiments.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
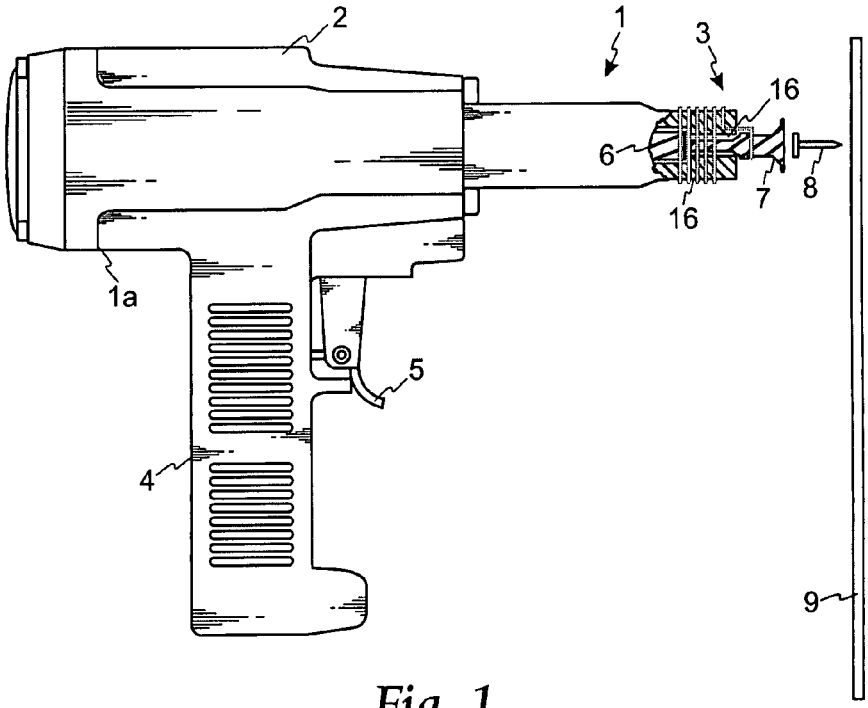
Fig. 1 (prior art)
FIG. 1 is a side view of a prior art fastener driving tool.

Referring to FIG. 1, a prior art fastener driving tool 1 is shown. The driving tool 1 has a housing 2. The housing 2 will generally have a hollow interior section which is used to enclose a driving mechanism 3. The housing 2 further includes a handle 4 which extends away from the main body 1*a*. The handle 4 will have a trigger 5. The trigger 5 is used for actuating the driving tool 1.

The driving mechanism 3 generally includes a driving mass 6 and a rivet die 7. When the trigger 5 is pulled, a driving force will force the driving mass 6 forward causing the driving mass 6 to strike the rear surface of the rivet die 7. The rivet die 7 will strike the head of the fastener 8 driving the fastener 8 into the surface 9 of an object. The rivet die 7 is generally held within the chamber 1*b* of the driving tool 1 by a spring 1*c* which is wound around the exterior of the housing 2. However, the prior art driving tool 1 has no way to effectively control the driving depth of the fastener 8. Thus, each fastener 8 is usually driven with the same amount of energy each time that the driving tool 1 is fired. This can cause the fastener 8 to be driven to an inconsistent depth and can cause the rivet die 7 to contact the surface 9 of the object with too much force causing damage to the surface 9.

Figure 2:
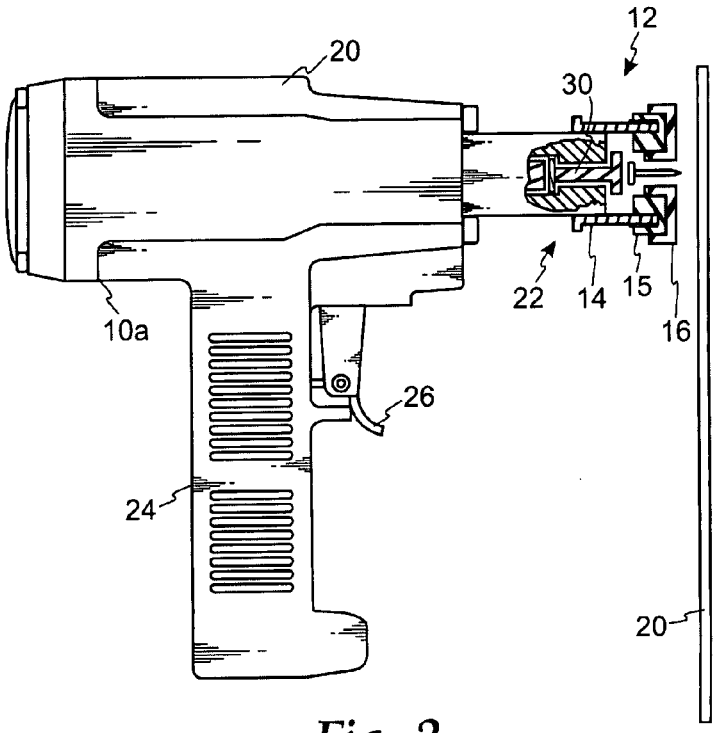
FIG. 2 is a side sectional view of an advantageous embodiment of a fastener driving tool of the present invention which allows controlled depth riveting.
Figure 3:
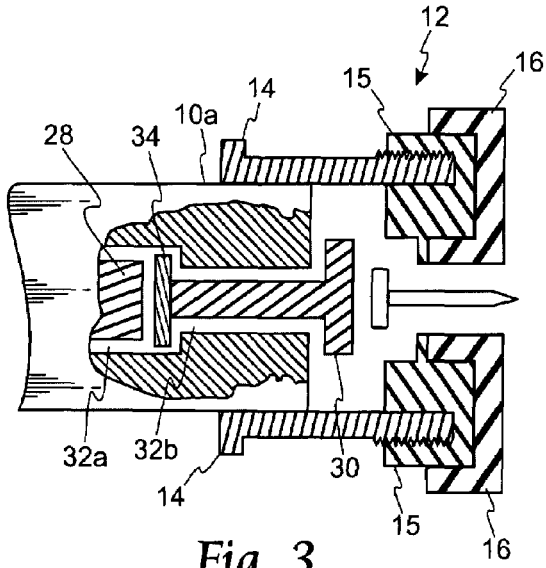
FIG. 3 is a magnified cross-sectional side view of the fastener driving tool of the present invention showing an advantageous embodiment of the mechanism which allows controlled depth riveting.
Figure 4:
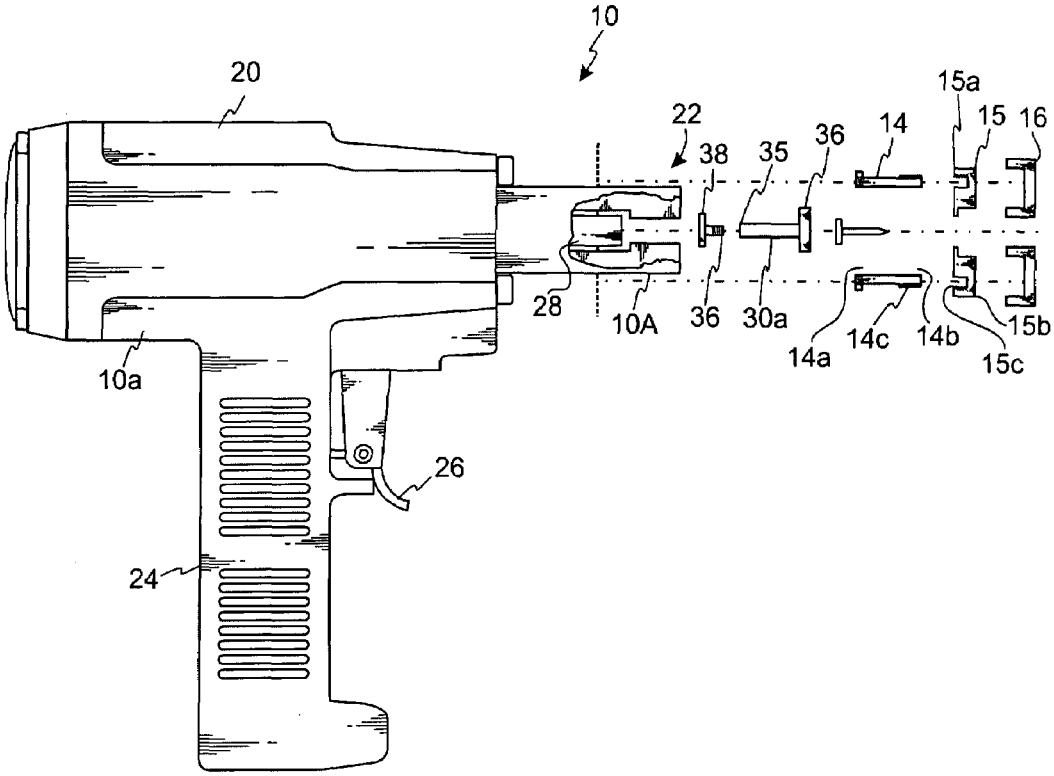
FIG. 4 is an exploded side view of an advantageous embodiment of the fastener driving tool of the present invention which allows controlled depth riveting.

Referring now to FIGS. 2-4, a fastener driving tool 10 (hereinafter tool 10) which allows controlled depth riveting is shown. The tool 10 has an adjustable depth control device 12. The adjustable depth control device 12 allows controlled depth riveting in order to prevent damage to a surface 20 of a structure. The adjustable depth control device 12 has an attachment device 14, an adjustment device 15, a bumper 16 which is coupled to the adjustment device 15, and a modified rivet die 30.

The adjustable depth control device 12 has an attachment device 14. The attachment device 14 is used to couple the adjustable depth control device 12 to the tool 10. The attachment device 14 is coupled to a front end 10*a* of the tool 10. The attachment device 14 is tubular in shape and has a first open end 14*a* and a second open end 14*b*. The first open end 14*a* of the attachment device 14 is slide on the tool 10 to couple the attachment device 14 to the tool 10. The diameter of the first open end 14*a* is slightly smaller than the diameter of the front end 10*a* of the tool 10. This will keep the adjustable depth control device 12 mounted on the tool 10 and prevent the attachment device 14 from slipping off of the tool 10 during use.

The attachment device 14 is generally formed of a strong and sturdy material. A metal such as heat treated steel or the like may be used for the attachment device 14. However, the listing of the above is given as an example and should not be seen as to limit the scope of the present invention.

An adjustment device 15 is coupled to the attachment device 14. The adjustment device 15 will allow one to adjust and control the driving depth of the tool 10. In accordance with one embodiment of the present invention, the adjustment device 15 is generally circular in shape and has a first end 15*a* and a second end 15*b*. The first end 15*a* of the adjustment device 15 is adjustably coupled to the second end 14*b* of the attachment device 14. The first end 15*a* of the adjustment device 15 has a plurality of threads 15*c* in an inner perimeter of the first end 15*a*. The threads 15*c* will engage a plurality of threads 14*c* located around an outer perimeter of the second open end 14*b* of the attachment device 14. By rotating the adjustment device 15 in a clockwise or counter clockwise direction, one can adjust and control the driving depth of the tool 10.

A bumper 16 is coupled to the adjustment device 15. The bumper 16 is used to prevent the adjustable depth control device 12 from scratching the surface 20 of an object when the tool 10 is being used. The bumper 16 is made of a material that will not scratch the surface 20 of an object. In general a material such as rubber, Teflon or the like is used. The bumper 16 is circular is shape has a first open end 16*a* and a second open end 16*b*. The first open end 16*a* of the bumper 16 is coupled to the second end 15*b* of the adjustment device 14. The second open end 16*b* allows the driving mechanism 22 to contact the fastener 40.

The tool 10 is similar to the driving tool 1. The tool 10 has a housing 20. The housing 20 will generally have a hollow interior section which is used to enclose a driving mechanism 22. The housing 20 further includes a handle 24 which extends away from the main body 10*a*. The handle 24 will have a trigger 26. The trigger 26 is used for actuating the tool 10.

The driving mechanism 22 generally includes a driving mass 28 and a rivet die 30 which is located in a chamber 32. The chamber 32 has a first section 32*a* having a first diameter and a second section 32*b* having a second diameter. The driving mass 28 is located in the first section 32*a*. The driving mass 28 is dimensioned so that the driving mass 28 cannot enter the second section 32*b*.

The rivet die 30 has a stem 30*a* and a striking head 36. The stem 30*a* is positioned in the second section 32*b* of the chamber 32 and extends into the first chamber 32*a*. Unlike prior art rivet dies, the rivet die 30 has stopping head 34. The stopping head 34 is generally a plate member located on an end 35 opposite of the striking head 36 of the rivet die 30. The stopping head 34 is used to prevent the rivet die 30 from leaving the chamber 32. The stopping head 34 further limits the distance the rivet die 30 may travel. The stopping head 34 has a length which is greater than the diameter of the second section 32*b*. Thus, when the tool 10 is actuated, the stopping head 34 will allow the rivet die 30 to travel a short distance before hitting and stopping at the opening to the second section 32*b*. Thus, the stopping head 34 will prevent the rivet die 30 from traveling too far and damaging the surface 20 of the object.

The stopping head 34 may be formed in a plurality of different manners. Prior art rivet dies may even be modified to add the stopping head 34. In accordance with one embodiment of the present invention, the driven end 35 of the rivet die 30 is counterbored. An adapter rod 36 that is thread on one end is inserted into the counterbored portion of the rivet die 30. A shouldered nut 38 is then coupled to the adapter rod 36. By inserting the rivet die 30 with the stopping head 34 into the chamber 32 of the tool 10, the rivet die 30 is captured and cannot come out. The rivet die 30 is also limited as to the distance the rivet die 30 may travel. The rivet die 30 can only travel a predetermined length. This allows the operator to install the fastener 40 at any head protrusion desire, eliminating any chance of micro-cracking in the countersink area of the structure. Since the rivet die 30 does not travel past the end of the nose piece of the adjustable depth control device 12, rivet die 30 contact with the surface 20 is impossible. The bumper 16 eliminates any chance of abrasion of the skin surface from the tool 10.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. An adjustable depth control device for a fastener driving tool comprising:

an attachment member to couple the adjustable depth control device to the fastener driving tool;

an adjustment member coupled to the attachment member to adjust and control a driving depth of the fastener driving tool; and a stopping head formed on a rivet die of the fastener driving tool for keeping the rivet die in a chamber of the fastener driving tool and for limiting a distance the rivet die will travel, wherein the stopping head comprises:

an adapter rod inserted into a bore formed in an end of the rivet die opposite of a striking head of the rivet die; and a shouldered nut coupled to an end of the adapter rod opposite of an end inserted into the channel.

2. An adjustable depth control device for a fastener driving tool in accordance with claim 1 further comprising a bumper coupled to the adjustment member.

3. An adjustable depth control device for a fastener driving tool in accordance with claim 2 wherein the bumper is formed of a material that prevents scratching of a surface.

4. An adjustable depth control device for a fastener driving tool in accordance with claim 1 wherein the attachment member comprises a tubular member having a first open end and a second open end, the first open end sliding on the fastener driving tool to couple the attachment member to the fastener driving tool.

5. An adjustable depth control device for a fastener driving tool in accordance with claim 4 wherein the adjustable depth control device further comprises:

a first set of threads formed around a first open end of the adjustment member; and a second set of threads located around the attachment member, the first set of threads engaging the second set of threads to adjust and control the driving depth of the fastener driving tool.

6. An adjustable depth control device for a fastener driving tool in accordance with claim 1 wherein the stopping head comprises a plate member coupled to an end of the rivet die opposite of a striking head of the rivet die.

7. An adjustable depth control device for a fastener driving tool in accordance with claim 1 wherein the stopping head further comprises:

a first set of threads formed on the adapter rod; and a second set of threads formed in the channel to coupled the adapter rod to the rivet die.

8. An adjustable depth control device for a fastener driving tool in accordance with claim 1 wherein the adjustment member comprises a circular shape member having a first end and a second end, the first end adjustably coupled to the attachment member.

9. A fastener driving tool for axially driving a fastener, comprising:

a gun body having channeling having a first and second section;

a driving mass, wherein the driving mass moves within the first section of the channeling;

a rivet die positioned in the second section of the channeling, an end of the rivet die extending into the first section of the channeling, the driving mass striking the rivet die when the fastener driving tool is actuated;

a stopping head formed on the rivet die for keeping the rivet die in the second section of the channeling and for limiting a distance the rivet die will travel;

an adjustable depth control device coupled to the fastener driving tool to adjust and control a driving depth of the fastener driving tool;

an attachment member to couple the adjustable depth control device to the fastener driving tool; and an adjustment member coupled to the attachment member to adjust and control a driving depth of the fastener driving tool;

wherein the stopping head comprises:

an adapter rod inserted into a hole formed in an end of the rivet die opposite of a striking head of the rivet die; and a shouldered nut coupled to an end of the adapter rod opposite of an end inserted into the channel.

10. A fastener driving tool for axially driving a fastener in accordance with claim 9 wherein the adjustable depth control device further comprises a bumper coupled to the adjustment member.

11. A fastener driving tool for axially driving a fastener in accordance with claim 10 wherein the bumper is formed of a material that prevents scratching of a surface.

12. A fastener driving tool for axially driving a in accordance with claim 9 wherein the attachment member comprises a tubular member having a first open end and a second open end, the first open end being slide on the fastener driving tool to couple the attachment member to the fastener driving tool.

13. A fastener driving tool for axially driving a fastener in accordance with claim 12 wherein the adjustable depth control device further comprises:

a first set of threads formed around a first open end of the adjustment member; and second set of threads located around the attachment member the first set of threads engaging the second set of threads to adjust and control the driving depth of the fastener driving tool.

14. A fastener driving tool for axially driving a fastener in accordance with claim 9 wherein the stopping head comprises a plate member coupled to an end of the rivet die opposite of a striking head of the rivet die.

15. A fastener driving tool for axially driving a fastener in accordance with claim 9 wherein the stopping head further comprises:

a first set of threads formed on the adapter rod; and a second set of threads formed in the channel to coupled ter rod to the rivet die.

16. A fastener driving tool for axially driving a fastener in accordance with claim 9 wherein the adjustment member comprises a circular shape member having a first open end and a second open end, the first open end adjustably coupled to the attachment member.

* * * * *